US005403164A

United States Patent [19]

Gama

[11] Patent Number: 5,403,164

[45] Date of Patent: Apr. 4, 1995

[54] AIR COMPRESSOR FOR INTERNAL COMBUSTION TWO CYCLE ENGINES

[76] Inventor: Luciano N. Gama, Rua Peru 145/203 - Sion, 30320-040 - Belo Horizonte - MG, Brazil

[21] Appl. No.: 120,531

[22] Filed: Sep. 14, 1993

[30] Foreign Application Priority Data

Sep. 22, 1992 [BR] Brazil ..... 9203733

[51] Int. Cl.[6] ..... F04B 17/00

[52] U.S. Cl. ..... 417/380; 92/181 P; 92/78; 184/6.24; 123/70 R

[58] Field of Search ..... 417/380, 392; 123/70 R, 123/41.86, 572; 92/78, 181 P; 184/6.24

[56] References Cited

U.S. PATENT DOCUMENTS

| | | | |
|---|---|---|---|
| 862,867 | 8/1907 | Eggleston . | |
| 1,102,321 | 7/1914 | Cochaud | 123/70 R |
| 2,916,251 | 12/1959 | Butts | 92/78 |
| 3,805,758 | 4/1974 | May | 417/380 |
| 4,002,104 | 1/1977 | Duer | 92/78 |
| 4,205,638 | 6/1980 | Vlacancinch | 123/70 R |
| 4,726,284 | 2/1988 | Green | 92/181 P |
| 5,069,192 | 12/1991 | Matsumoto et al. | 123/572 |

*Primary Examiner*—Richard A. Bertsch
*Assistant Examiner*—M. Kocharov
*Attorney, Agent, or Firm*—Dowell & Dowell

[57] ABSTRACT

A passive compressor is disclosed which includes a free piston or a flexible membrane whose movement is controlled by pressure variations in a main chamber. The pressure in the main chamber changes according to the pressure in the motor crankcase, as the main chamber is coupled to the crankcase by a crankcase transfer passage duct.

As the free piston or flexible membrane moves towards the main chamber, it causes a pressure decrease in the air chamber which subsequently admits external air through an inlet valve. When the free piston or the flexible membrane moves in the direction of the air chamber, the increased pressure on the piston or membrane forces the external air into the motor cylinder, through an air transfer passage duct, and towards a port on the cylinder that is opened due to the position of the motor piston. The inlet valve prevents the loss of pressure in the air chamber. Alternatively, the main chamber may be directly attached to the motor crankcase. In such case, the crankcase transfer passage duct is not provided.

The compressor may be equipped with a device for discharging the combustion gases that pass from the motor crankcase. In the compressor equipped with a free piston, the device includes passage holes, a cap and an oil separator. In the compressor with the flexible membrane, the device includes an auxiliary piston, an auxiliary cylinder and a cap which has an entrance for placing the oil separator.

8 Claims, 3 Drawing Sheets

AIR COMPRESSOR FOR INTERNAL COMBUSTION TWO CYCLE ENGINES

BACKGROUND OF THE INVENTION

Technical Field

This invention is directed to the field of two cycle internal combustion engines and, more particularly, to a passive air compressor for charging two cycle engines with air for the combustion process. The air compressor eliminates the need of mixing lubricant oil in the fuel.

History of the Related Art

Modern two cycle engines can be classified into two main groups, according to how they are supplied with air needed to burn the fuel. The first group includes engines with crankcase compression and the second includes engines having an external air compressor or blower. The first group includes some types of motorcycle, automobile, boat and aircraft engines. The second group includes mainly two cycle Diesel engines.

In the motors of the first group, a mixture of air and fuel from the carburetor, charges the crankcase when it is low pressurized by the movement of the motor piston from the bottom dead center position to the top dead center position. On the down stroke of the piston, the mixture is compressed and then forced to pass through a transfer passage duct towards the air port on the motor cylinder, that is opened by the movement of the motor piston. Because of the flow of gases and fuel in the crankcase, the internal lubrication in this kind of two cycle engine is achieved by the dilution of lubricating oil in the fuel.

In the engines of the second group, atmospheric air is compressed by an external device and is then forced up into the engine cylinder through a port opened by the movement of the piston. Thus, in these engines there is no such flow of gases in the crankcase, similar to what occurs in four cycle engines.

The two cycle engines with external air compression have better lubricating systems. Their main disadvantage, however, is the bulkiness and complexity of the existing systems, which require more work to construct and maintain the engines. The compressor itself also requires some energy to perform its work.

SUMMARY OF THE INVENTION

The present invention provides a simplified air compressor that, if applied to a two cycle engine, allows the use of a lubricating system that is also used in four cycle engines. It may be termed a passive compressor, in that the air intake and compression actually occur by the movement of the engine piston, as in conventional two cycle engines with crankcase compression. The main difference is that the device in accordance with the invention separates the gases in the crankcase and the atmospheric air that is used for the combustion process.

The air compressor in accordance with the invention may be described as having two chambers; that is, one chamber that is attached to the crankcase and another chamber that receives the air. Between the chambers, a pressure coupling device is provided that may be in the form of a flexible membrane or a free piston.

The two chambers of the air compressor are referred to herein as the main chamber and the air chamber. The main chamber is attached to the motor crankcase by means of a transfer passage duct. The air chamber has an intake valve and a transfer passage duct that communicates with the air port in the motor cylinder.

The free piston or flexible membrane moves according to the movement of the motor piston, because the changes of pressure in the crankcase, due to the piston's movement, are transmitted to the main chamber. Thus, when the motor piston moves upward to the top dead center position, its displacement enlarges the crankcase volume, which causes the pressure inside the crankcase to fall below atmospheric pressure. As the main chamber is attached to the motor crankcase, this low pressure causes the free piston to move towards the main chamber to compensate for this decrease of pressure. As the free piston moves, the pressure in the air chamber also falls below atmospheric pressure. This causes air to enter the air chamber through the intake valve. At this time, the air port in the motor cylinder is closed by the piston. When the motor piston moves downward to the bottom dead center position, its displacement compresses the crankcase gases and this compression is transmitted to the main chamber. As a result, the free piston is forced to move towards the air chamber and compress the air admitted into the air chamber in the last step. The compressed air flows through the transfer passage duct and into the motor cylinder as soon as the movement of the motor piston uncovers the air port on the cylinder.

The invention provides two ways to compensate for the unwanted and progressive increase of pressure in the crankcase, caused by the existence of oil vapor and combustion gases passed along the motor cylinder. More particularly, a compressor is provided with a membrane and another with a free piston. Both devices work on the same following principle: if the pressure in the crankcase is increased by the existence of excess gases, the free piston (or membrane) will surpass an ideal maximum position towards the top of the air chamber. In the case of the free piston, when it reaches a certain amount of displacement from the ideal maximum position, holes on the piston walls are uncovered by the movement of the piston, allowing a flow of extra gases to the air chamber. These gases are then mixed with the air admitted in the next cycle and directed into the combustion chamber. The correct positioning and sizes of the holes ensures that the right amount of extra gases is discharged and, in the next cycle, that the piston returns to the ideal maximum position. The holes are protected by a cap shaped like a funnel, which has an oil separator to prevent oil passage to the air chamber.

The compressor with a flexible membrane comprises an auxiliary piston, an auxiliary cylinder and a cap provided with an oil separator. The auxiliary piston is hollow and is attached at one side to the flexible membrane. On the opposite side, the auxiliary piston has windows or holes through which the extra gases pass. The auxiliary piston moves into the auxiliary cylinder according to the movement of the flexible membrane. The cap covers the piston and the auxiliary cylinder, and has a passage where an oil separator is placed. When the extra gases in the crankcase produce enough displacement of the auxiliary piston, the windows or holes are uncovered, allowing the extra gases to pass into the air chamber.

BRIEF DESCRIPTION OF THE DRAWINGS

The accompanying schematical drawings form a part of the specification in which like reference numerals are employed to indicate like parts in all the drawings.

DETAILED DESCRIPTION OF THE PREFERRED EMBODIMENTS

Figure 1:
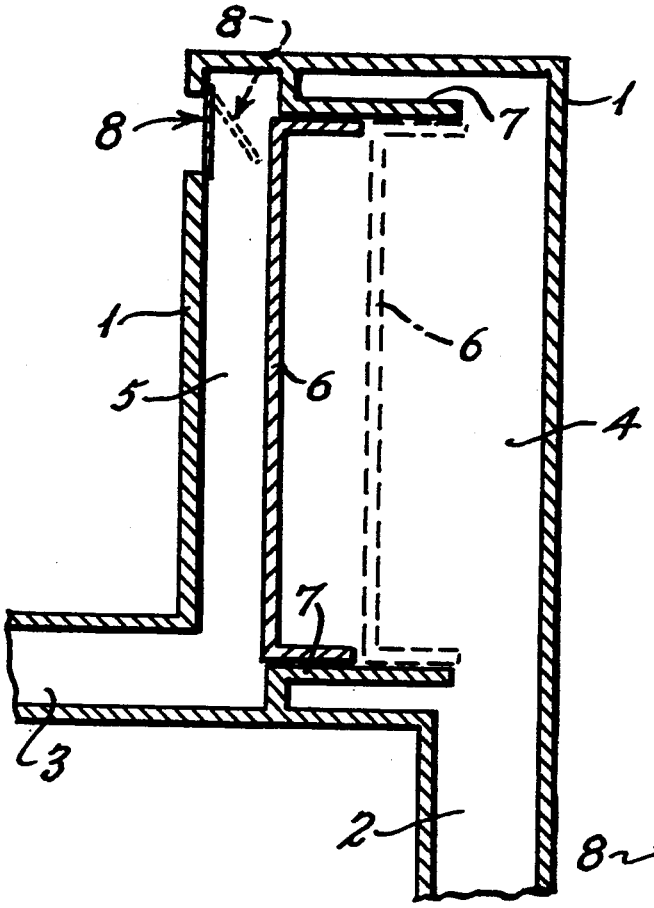
FIG. 1 is a section view partially in broken line of a compressor in accordance with the invention including a free piston.

FIG. 1 illustrates a compressor in accordance with a preferred embodiment of the invention including a free piston 6, a case 1 and a cylinder 7. The free piston 6 is depicted during compression and in dotted line during aspiration. During compression, inlet valve 8 is closed and during aspiration it is opened as represented in dotted line. A transfer passage duct 2 leads to the motor crankcase (not shown) and main chamber 4, and an air transfer passage duct 3 leads to an air port in the motor cylinder (not shown) and air chamber 5.

Figure 2:
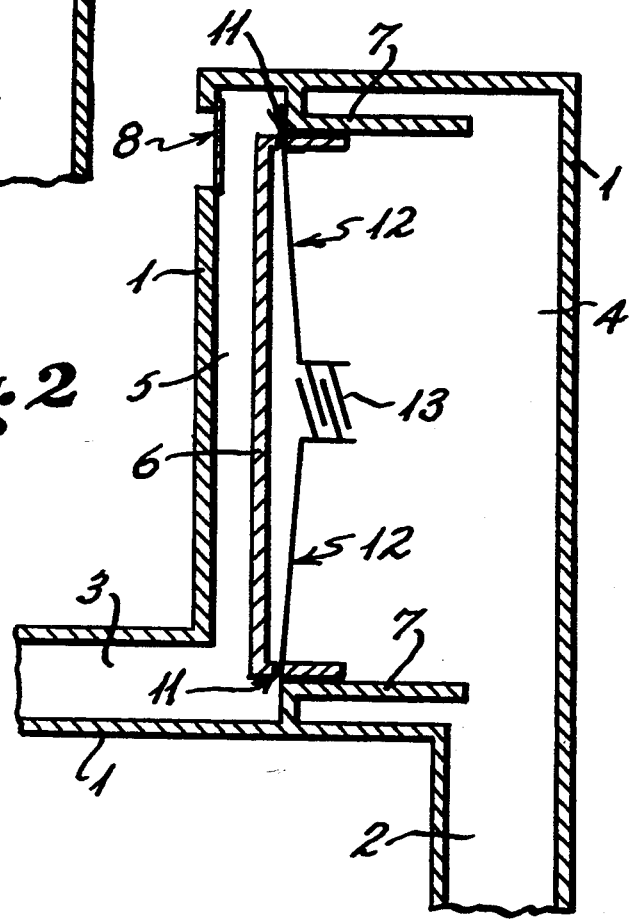
FIG. 2 is a section view of the compressor shown in FIG. 1, equipped with a device for discharging gases passed from the motor crankcase.

FIG. 2 illustrates the compressor shown in FIG. 1 equipped with a device for discharging gases passed from the motor crankcase. These gases cause an unwanted pressure increase in the motor crankcase and in the main chamber 4. Oil vapor, generated by the high oil temperature, causes the same effect. This increase of pressure tends to displace the free piston 6 from the maximum and minimum positions illustrated in FIG. 1, towards the top of the air chamber 5.

The device includes passage holes 11 provided on the walls of the free piston 6 and a cap 12 that is shaped like a funnel. In the neck of the cap, an oil separator 13 is disposed which has a labyrinth or spiral shape.

Figure 3:
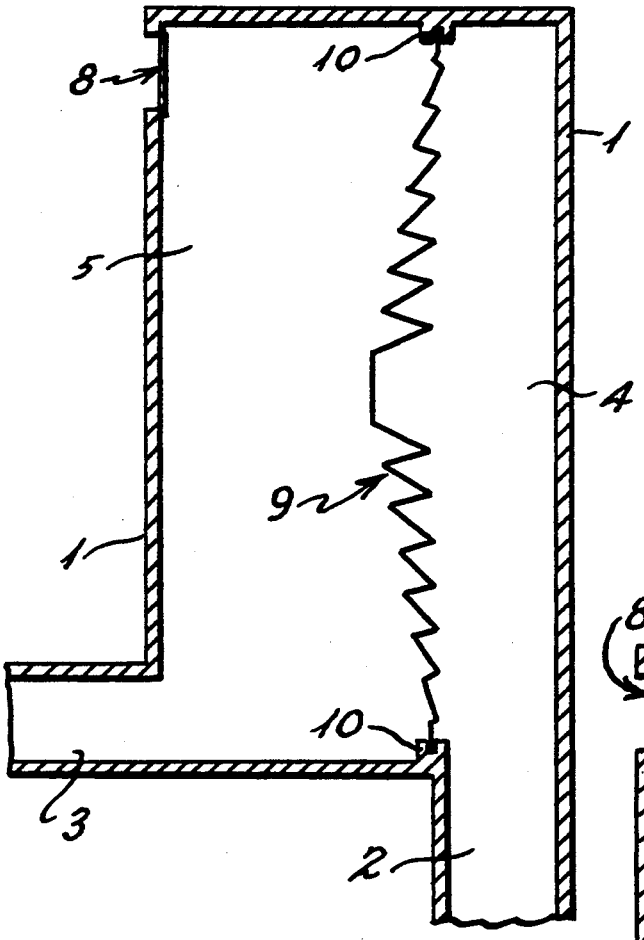
FIG. 3 is a section view of a compressor in accordance with the invention including a flexible membrane.

FIG. 3 illustrates an embodiment of the compressor including a flexible membrane 9 instead of a free piston. This embodiment of the compressor operates in the same manner as the compressor shown in FIG. 1. However, the free piston 6 and the cylinder 7 are modified by the flexible membrane 9 and its membrane stand 10.

Figure 4:
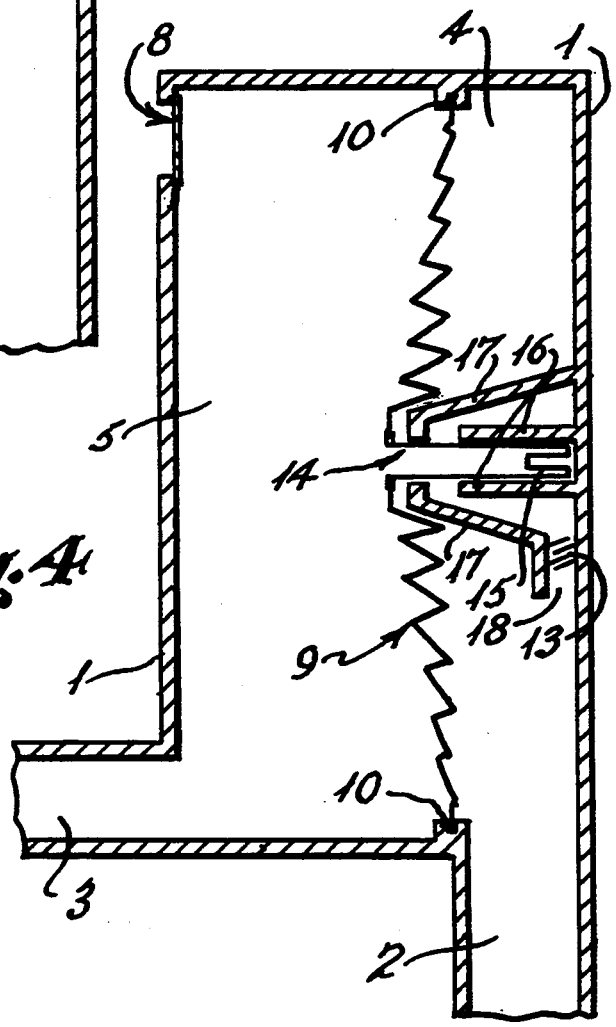
FIG. 4 is a section view of the compressor shown in FIG. 3, equipped with a device for discharging excess gases.

FIG. 4 illustrates the compressor shown in FIG. 3, equipped with a device for discharging gases. This device comprises an auxiliary piston 14, an auxiliary cylinder 16 and a cap 17, having an entrance 18 at which an oil separator 13 is provided. The auxiliary piston 14 is hollow and is attached at one side to the flexible membrane 9. At another side, the auxiliary cylinder 16 has a window 15 for the passage of the excess gases. The excess gases force the membrane and the auxiliary piston 14 to gradually displace towards the air chamber 5. When the displacement is sufficient to uncover the passage window 15, the excess gases then have a passage through which to pass from the main chamber 4 to the air chamber 5. The oil separator placed in the entrance 18 of the cap 17 prevents oil passage to the air chamber 5.

Figure 5:
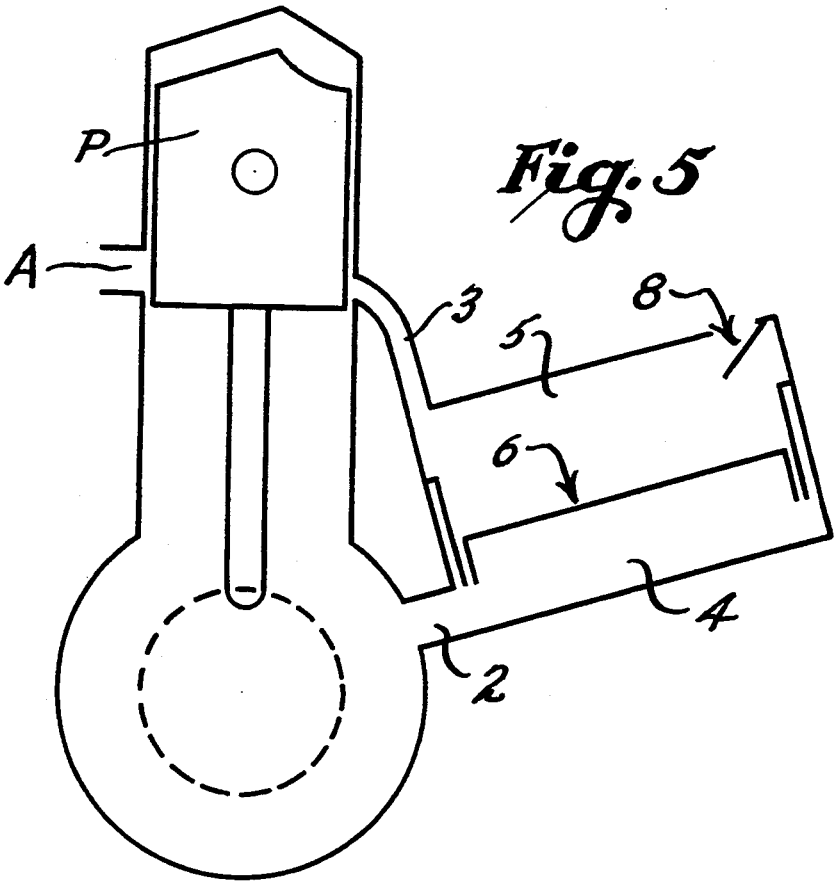
FIG. 5 is a section view illustrating the free piston compressor attached to a two cycle engine, with the motor piston at the top dead center position.

FIG. 5 illustrates the free piston compressor in accordance with the invention attached to a two cycle engine, with the motor piston P being at the top dead center position. In this position, the motor crankcase is under low pressure because of the upper location of the motor piston. The transfer passage duct 2 is connected to the main chamber 4 and, as a result, the free piston 6 is forced downward until it reaches its lowest position. This displacement of the free piston 6 causes a decrease of pressure in the air chamber 5, which is then filled with the air passed through the opened inlet valve 8. At this time, the air port A in the motor cylinder is closed by the motor piston.

Figure 6:
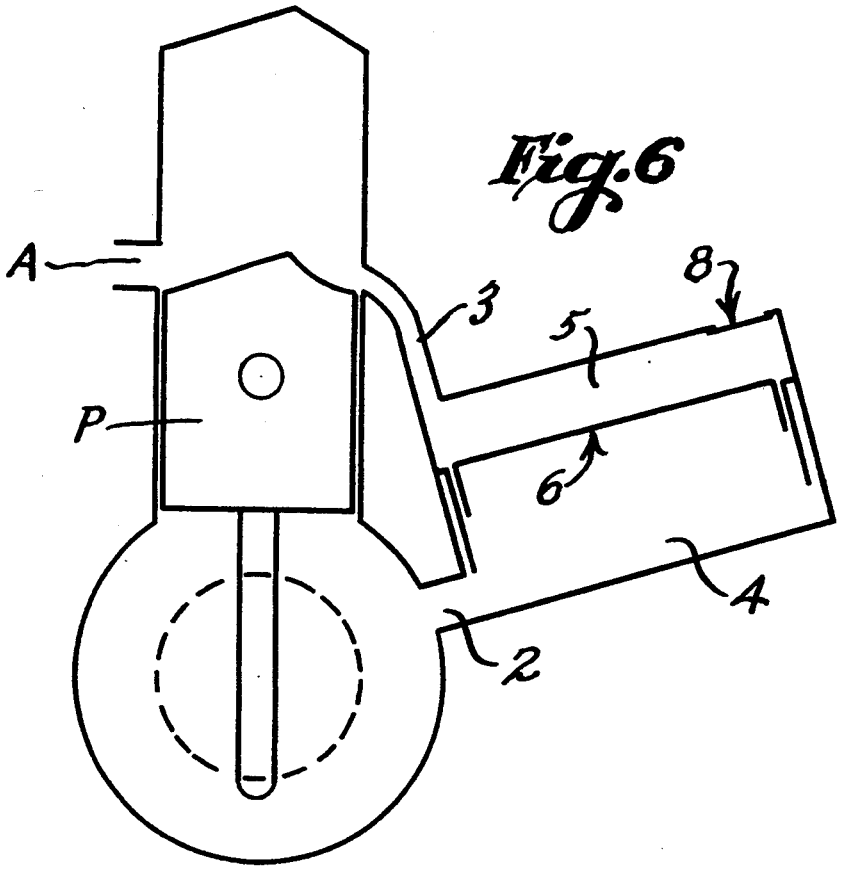
FIG. 6 shows the engine illustrated in FIG. 5 with the motor piston at the bottom dead center position.

FIG. 6 shows the opposite situation of the engine as illustrated in FIG. 5. The motor piston P is at the bottom dead center position, and the motor crankcase, the main chamber 4 and the air chamber 5 are under high pressure. The inlet valve 8 is closed and the air port A in the cylinder is opened. The air admitted into the air chamber in the last step is then forced to flow through the air transfer passage duct 3 and into the cylinder.

The invention provides a simplified compressor for charging a two cycle engine, therefore eliminating the need to mix lubricant oil into the fuel. The invention eliminates some of the problems of the known engines, such as excessive production of smoke, problems with spark plugs, and carbon deposits forming in the combustion chamber and exhaust system. The system is suited for engines that use various kinds of fuel, the most common being gasoline or diesel. In a gasoline engine, a carburetor or an electronic fuel injection system is placed in the air transfer duct 3 or next to the inlet valve 8. In a diesel engine, a mechanical fuel injection system is suitable for use.

It is claimed:

1. An air compressor for an internal combustion two cycle engine including a motor piston, a motor crankcase and a motor combustion chamber having an air inlet port, the compressor comprising:

a main chamber in fluid communication with the motor crankcase;

an air chamber having an air inlet and an air outlet, said air outlet being in fluid communication with the air inlet port of the motor combustion chamber when the motor piston is in a first position;

compression means disposed between said main chamber and said air chamber for compressing air in said air chamber, said compression means including apertures providing fluid communication between said main chamber and said air chamber when the pressure in said main chamber is above a predetermined presssure; and an oil separator disposed in said main chamber such that fluid passes through said oil separator before passing from said main chamber to said air chamber through said apertures.

2. An air compressor for an internal combustion two cycle engine including a motor piston, a motor crankcase and a motor combustion chamber having an air inlet port, the compressor comprising:

a main chamber in fluid communication with the motor crankcase;

an air chamber having an air inlet and an air outlet, said air outlet being in fluid communication with the air inlet port of the motor combustion chamber when the motor piston is in a first position;

a free piston separating said main chamber and said air chamber, said free piston including apertures providing fluid communication between said main chamber and said air chamber when the pressure in said main chamber is above a predetermined pressure; and an oil separator disposed in said main chamber such that fluid passes through said oil separator before passing from said main chamber to said air chamber through said apertures.

3. The air compressor of claim 2, further comprising a funnel-shaped cap secured to said free piston and disposed in said main chamber, said cap having a neck in which said oil separator is disposed.

4. The air compressor of claim 3, wherein said oil separator has a labyrinth shape.

5. The air compressor of claim 3, wherein said oil separator has a spiral shape.

6. The air compressor of claim 2, wherein said air inlet comprises an inlet valve, said inlet valve being adapted to open to allow air to enter said air chamber when the motor piston is in a second position and covers the air inlet port of the motor combustion chamber, and said inlet valve being adapted to close to terminate the flow of air into said air chamber when the motor piston is in the first position in which said air outlet is in fluid communication with the air inlet port.

7. An air compressor for an internal combustion two cycle engine including a motor piston, a motor crankcase and a motor combustion chamber having an air inlet port, the compressor comprising:

first and second opposed sidewalls and opposed endwalls;

a main chamber in fluid communication with the motor crankcase;

an air chamber having an air inlet and an air outlet, said air outlet being in fluid communication with the air inlet port of the motor combustion chamber when the motor piston is in a first position;

an auxiliary cylinder extending interiorly from said first sidewall, said cylinder defining a cylinder opening;

a cap extending interiorly from said first sidewall and surrounding said cylinder, said cap defining a cap opening in alignment with said cylinder opening and a fluid inlet passage;

an auxiliary piston movably received in said cylinder opening and said cap opening, said auxiliary piston defining a piston opening in alignment with said cylinder opening and said cap opening and a fluid transfer passage;

a flexible membrane movably secured to said auxiliary piston and extending between said endwalls, said flexible membrane separating said main chamber and said air chamber;

said fluid transfer passage of said auxiliary piston being in fluid communication with said fluid inlet passage so as to allow fluid to pass from said main chamber to said air chamber through said cylinder opening when the pressure in said main chamber is above a predetermined presssure; and an oil separator disposed in said fluid inlet passage such that fluid passes through said oil separator before passing from said main chamber to said air chamber.

8. The air compressor of claim 7, wherein said air inlet comprises an inlet valve disposed in said second sidewall, said inlet valve being adapted to open to allow air to enter said air chamber when the motor piston is in a second position and covers the air inlet port of the motor combustion chamber, and said inlet valve being adapted to close to terminate the flow of air into said air chamber when the motor piston is in the first position in which said air outlet is in fluid communication with the air inlet port.

* * * * *